US009366176B2

(12) United States Patent
Faulkner et al.

(10) Patent No.: US 9,366,176 B2
(45) Date of Patent: Jun. 14, 2016

(54) SPLIT COOLING METHOD AND APPARATUS

(71) Applicant: Norfolk Southern Corporation

(72) Inventors: Donald R. Faulkner, Hollidaysburg, PA (US); William B. Thompson, Claysburg, PA (US); Patrick E. Keister, Vinton, VA (US); Eric C. Martin, Roanoke, VA (US); Charles W. Murray, Boones Mill, VA (US)

(73) Assignee: NORFOLK SOUTHERN CORPORATION, Norfolk, VA (US)

( * ) Notice: Subject to any disclaimer, the term of this patent is extended or adjusted under 35 U.S.C. 154(b) by 0 days.

(21) Appl. No.: 14/073,045

(22) Filed: Nov. 6, 2013

(65) Prior Publication Data

US 2014/0060463 A1 Mar. 6, 2014

Related U.S. Application Data

(63) Continuation of application No. 13/050,256, filed on Mar. 17, 2011, now Pat. No. 8,601,986.

(51) Int. Cl.

| | |
|---|---|
| ***F01P 3/20*** | (2006.01) |
| ***F01P 3/12*** | (2006.01) |
| ***F01P 7/16*** | (2006.01) |
| *F02B 29/04* | (2006.01) |

(52) U.S. Cl.

CPC . *F01P 3/12* (2013.01); *F01P 7/165* (2013.01); *F01P 2060/02* (2013.01); *F02B 29/0406* (2013.01)

(58) Field of Classification Search

CPC ..... F01P 3/12; F01P 7/165; F01P 3/20

USPC ..... 123/41.29, 41.31, 41.33

See application file for complete search history.

(56) References Cited

U.S. PATENT DOCUMENTS

| | | | | |
|---|---|---|---|---|
| 3,397,684 | A | | 8/1968 | Scherenberg |
| 3,425,400 | A | | 2/1969 | Scherenberg |
| 3,752,132 | A | | 8/1973 | Bentz et al. |
| 3,863,612 | A | | 2/1975 | Wiener |
| 4,061,187 | A | | 12/1977 | Rajasekaran et al. |
| 4,236,492 | A | | 12/1980 | Tholen |
| 4,765,284 | A | | 8/1988 | Kanazawa et al. |
| 4,885,911 | A | * | 12/1989 | Woollenweber et al. .. 123/41.49 |

(Continued)

OTHER PUBLICATIONS

Int'l Search Report (Mar. 17, 2011).

(Continued)

*Primary Examiner* — Lindsay Low
*Assistant Examiner* — Kevin Lathers
(74) *Attorney, Agent, or Firm* — Goodwin Procter LLP

(57) ABSTRACT

A system and method for cooling an internal combustion engine. In one embodiment of the invention a cooling system for an internal combustion engine is disclosed, comprising an engine; an intercooler for receiving combustion air from a turbocharger, the intercooler comprising an air-to-liquid heat exchanger for exchanging heat between the combustion air and a liquid coolant; an intercooler radiator; at least one engine coolant radiator; an expansion tank; an oil cooler; and at least one pump, wherein the dedicated fan is controlled by a temperature switch or controller and wherein the at least one engine coolant radiator and the intercooler radiator are located on opposite sides of the engine.

9 Claims, 7 Drawing Sheets

(56) References Cited

U.S. PATENT DOCUMENTS

| | | | | |
|---|---|---|---|---|
| 4,961,404 | A * | 10/1990 | Itakura et al. | 123/41.31 |
| 5,201,285 | A * | 4/1993 | McTaggart | 123/41.31 |
| 5,910,099 | A | 6/1999 | Jordan, Jr. et al. | |
| 6,006,731 | A | 12/1999 | Uzkan | |
| 6,230,668 | B1 * | 5/2001 | Marsh et al. | 123/41.44 |
| 6,445,997 | B2 * | 9/2002 | Thomas | 701/113 |
| 6,604,515 | B2 * | 8/2003 | Marsh et al. | 123/41.31 |
| 7,131,403 | B1 | 11/2006 | Banga et al. | |
| 2004/0140366 | A1 | 7/2004 | Uzkan | |

OTHER PUBLICATIONS

Written Opinion (Mar. 17, 2011).

* cited by examiner

SPLIT COOLING METHOD AND APPARATUS

CROSS REFERENCE OF RELATED APPLICATIONS

This application is a continuation of and claims priority to U.S. patent application Ser. No. 13/050,256, filed on Mar. 17, 2011, which is incorporated herein by reference in its entirety.

TECHNICAL FIELD

The present invention is in the field of locomotive diesel engines and cooling systems. More particularly, the present invention is in the technical field of cooling systems for diesel engines utilizing multiple flow paths to provide flexibility, efficiency and reduced emissions.

BACKGROUND OF THE INVENTION

Cooling systems for internal combustion engines, such as those powering locomotives, are known in the art for the purpose of maintaining engine temperature and lubricating oil temperatures within desired operating parameters. In addition, the cooling system is used to reduce the temperature of the charge air. In typical cooling systems, ambient air is forced through heat exchangers and the cooling capability is constrained by the temperature of the ambient air as well as other factors. There are two common types of cooling systems commonly found in locomotives.

For example, the first type of cooling system consists of a Y-shaped pipe on the engine which splits the coolant flow into two radiators. The coolant exits both the radiators and enters an oil cooler, which is in parallel to an expansion tank. From the oil cooler the coolant is combined with the outlet of the expansion tank and then it enters a pair of pumps that are mounted on the engine block. The pumps then circulate the coolant through fluid passages within the engine. Some of the fluid flows through passages in the cylinder liners and heads while the remainder exits the engine at the opposite end of the pumps and enters a pair of intercoolers that are located on each side of the engine. After the coolant absorbs the heat from the intercooler, it then re-enters the engine via another fluid passage and combines with the fluid coming from the cylinder liners and heads. The coolant then exits the engine and is diverted through the Y-shaped pipe to the radiators restarting the cooling process.

The above prior art cooling system allows the engine cylinder liners, cylinder heads, oil cooler and the intercoolers and crankcase exhaust elbows that are located in the upper deck of the crankcase to be maintained at acceptable temperature levels. The coolant temperature is at its lowest as it is coming out of the radiators, and this coolant is provided to the oil cooler. As the coolant continues through the system and flows through the engine and intercoolers, it may warm up considerably and not lose heat until it once again passes through the radiators. In this typical prior art cooling system, the engine coolant enters the engine around 180 degrees Fahrenheit and exits the engine around 190 degrees Fahrenheit.

The second type of prior art cooling system is similar to the first type with the exception that the coolant flows out of the engine through a water discharge header and is combined with coolant that exits from the intercooler and turbocharger. The coolant then enters a control valve that will either direct the coolant to the radiator or expansion tank depending upon the temperature of the coolant. If the coolant is warm, it will be directed to the radiators and then to the expansion tank.

The coolant then passes through the oil cooler to a pump which circulates the coolant through the water inlet header into the engine turbocharger and intercoolers. If the coolant temperature is cold, which is typical during engine start up, the control valve shall route the coolant such that it bypasses the radiators, and flows directly into the expansion tank, and continues the process as described above. This type of cooling system is designed to maintain a coolant temperature between 182 degrees Fahrenheit and 200 degrees Fahrenheit.

These traditional cooling systems of the prior art have a disadvantage because these systems do not allow the flexibility to provide a lower coolant temperature to the intercoolers. The lowest coolant temperature that is received by the intercoolers of both systems is dictated by the coolant temperature that is required by the cylinder liners and cylinder head.

The disclosed split cooling system and method is directed to overcoming one or more of the disadvantages listed above.

SUMMARY OF THE INVENTION

In one aspect, the present invention disclosed herein is directed to a cooling system for an internal combustion engine, comprising an engine; at least one intercooler for receiving combustion air from a turbocharger, the intercooler comprising an air-to-liquid heat exchanger for exchanging heat between the combustion air and a liquid coolant; an intercooler radiator; at least one engine coolant radiator; an expansion tank; an oil cooler; and at least one pump, wherein the dedicated fan is controlled by a temperature switch or microprocessor controller and wherein the at least one engine coolant radiator and the intercooler radiator are located on opposite sides of the engine.

DETAILED DESCRIPTION OF THE INVENTION

The present application is directed toward the technical field of cooling systems for diesel engines utilizing multiple flow paths to provide flexibility efficiency, and reduced emissions.

Figure 1:
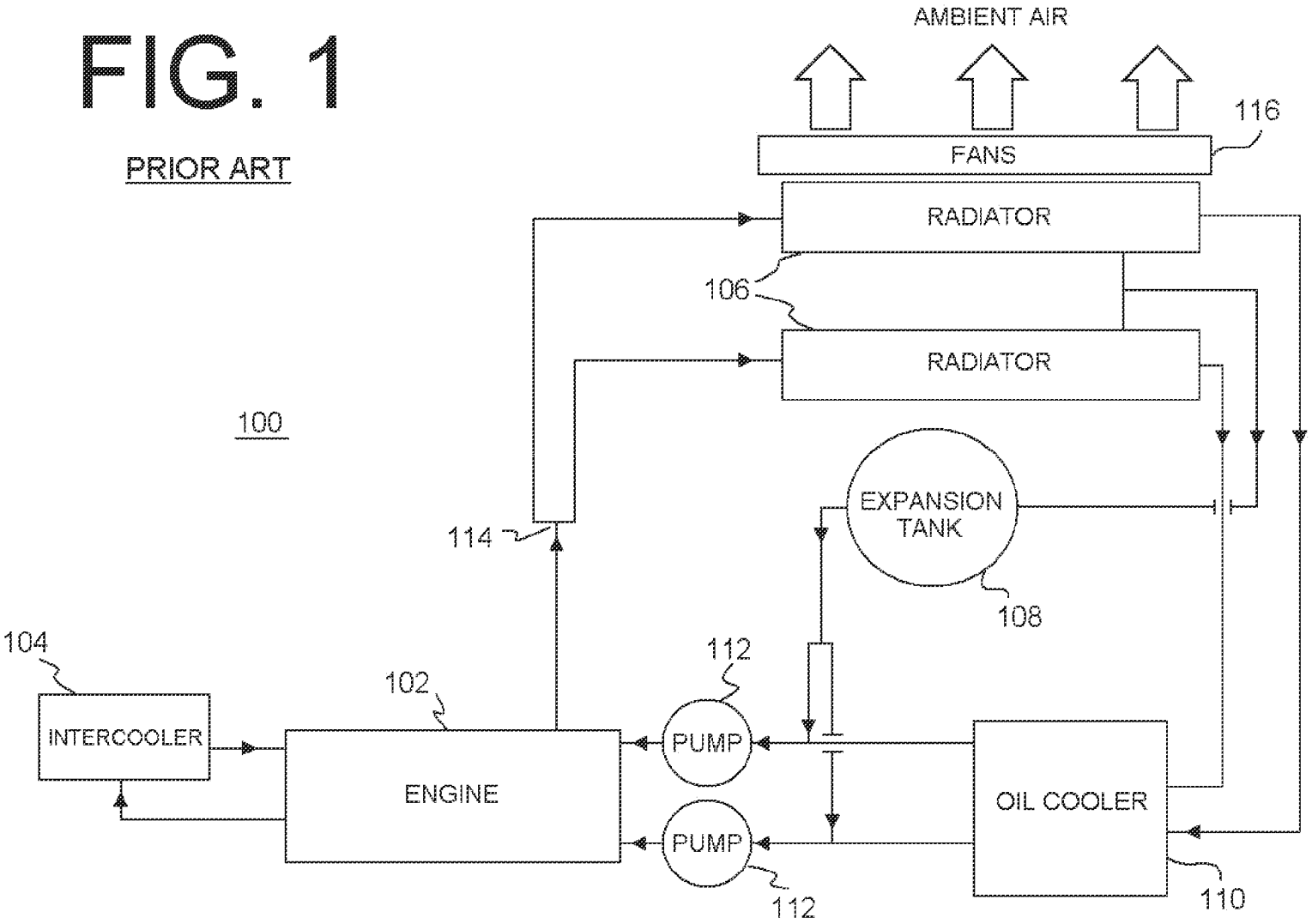
FIG. 1 PRIOR ART
FIG. 1 is a diagram of a prior art cooling system for a diesel locomotive engine.
Figure 2:
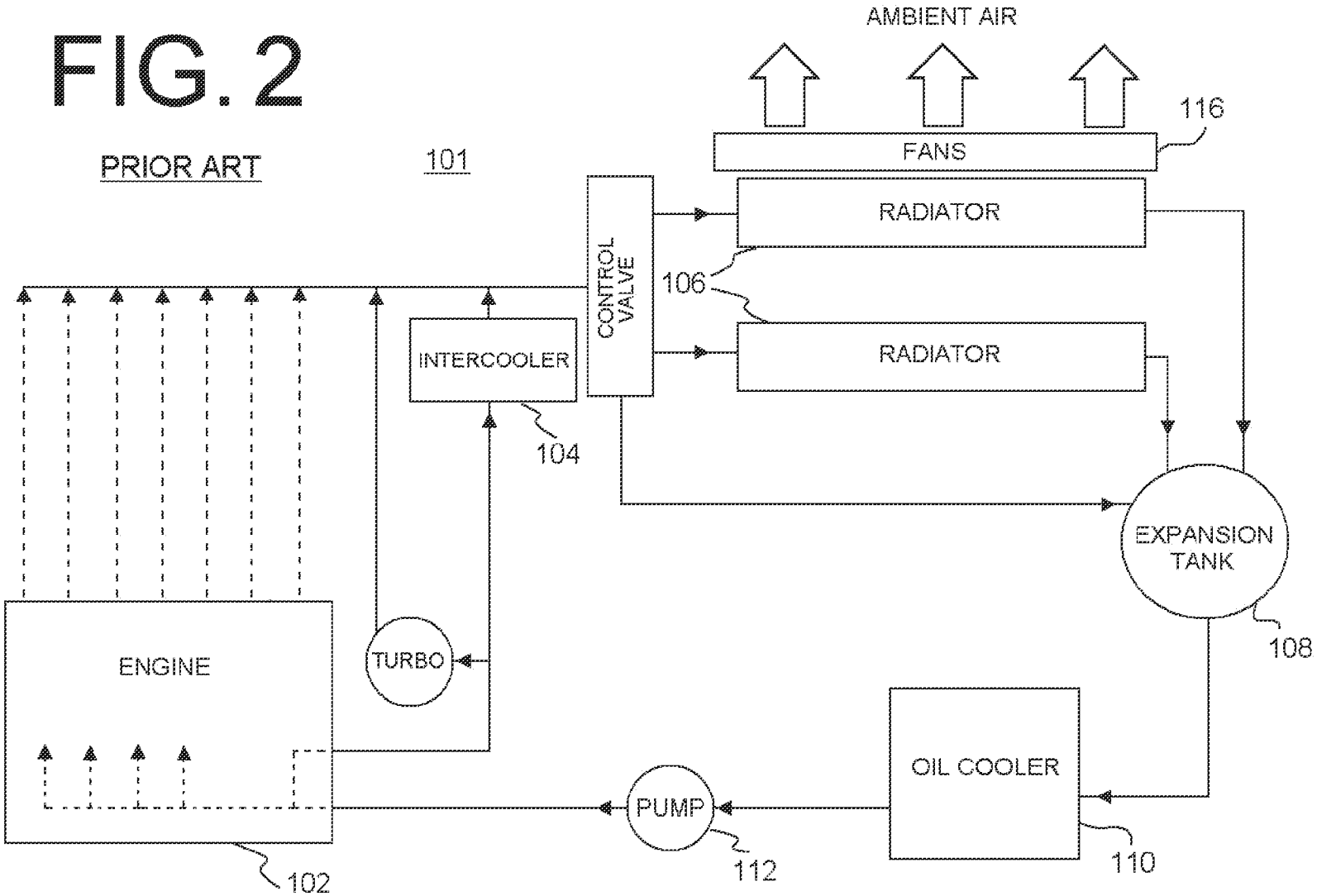
FIG. 2 PRIOR ART
FIG. 2 is an diagram of another prior art system for a diesel locomotive engine

Referring to FIG. 1, a typical prior art cooling system 100 is depicted. Cooling system 100 may include an engine 102, at least one intercooler 104, at least one radiator 106, an expansion tank 108, an oil cooler 110, and at least one pump 112. Cooling system 100 is generally utilized to maintain certain optimal temperatures of various components in cooling system 100 by circulating a liquid coolant, such as water that may include chemical additives such as anti-freeze and corrosion inhibitors. Cooling system 100 also includes piping for interconnecting the various components of the system and associated valves, as will be described more fully below.

Engine 102 includes internally formed cooling passages and/or a water jacket through which the some of the liquid coolant flows and absorbs energy from engine 102, thereby cooling engine 102. At least one pump 112 is used to circulate the liquid coolant throughout cooling system 100, as described below.

The remainder of the liquid coolant exits engine 102 and is directed to at least one intercooler 104, said intercooler used to improve the volumetric efficiency of engine 102 by increasing the intake air charge density. For example, as air is compressed in the turbocharger (not shown), the temperature of the air increases, which consequently decreases the air density of the charge air delivered to the cylinders in engine 102. This hotter, less dense air decreases combustion efficiency. In order to increase combustion efficiency, at least one intercooler 104 lowers the temperature of the charge air to increase the air's density, which in turn increases combustion efficiency. Intercooler 104 may be a charge air cooler which utilizes an air-to-liquid heat exchange device. As the liquid coolant flows through intercooler 104, heat may be transferred from intercooler 104 to the liquid coolant. After the liquid coolant exits intercooler 104, it is directed back into engine 102, where it enters another fluid passage and combines with the coolant that has passed through the water jacket.

After the liquid coolant exits engine 102, it may be diverted by a Y-pipe device 114 into at least one parallel flow path. In the prior art cooling system 100 shown in FIG. 1, device 114 is a Y-pipe which separates the liquid coolant into two parallel flow paths. However, any number of parallel flow paths may be utilized. After the liquid coolant travels through the Y-Pipe device 114 (if used) and is diverted into the appropriate number of flow paths, it next enters at least one radiator 106.

Radiator 106 may be a heat exchange device of any type used in the art of engine cooling systems. As the liquid coolant flows through at least one radiator 106, at least one fan 116 will provide an increased air flow through radiator 106 and the liquid coolant will lose some its accumulated heat and return to a lower temperature. As the cooler liquid coolant exits at least one radiator 106, at least a portion of the liquid coolant is directed to oil cooler 110. Oil cooler 110 is another heat exchange device used to maintain the lubricating oil for engine 102 at an optimal temperature. The remainder of the liquid coolant not directed to oil cooler 110 may be directed to expansion tank 108.

As the liquid coolant exits oil cooler 110, it may be combined with the outlet of expansion tank 108, and the combined liquid coolant flow path may then enter at least one pump 112. At least one pump 112 may be mounted on engine 102. At least one pump 112 may then circulate the liquid coolant through engine 102, restarting the cooling cycle described above.

Figure 3:
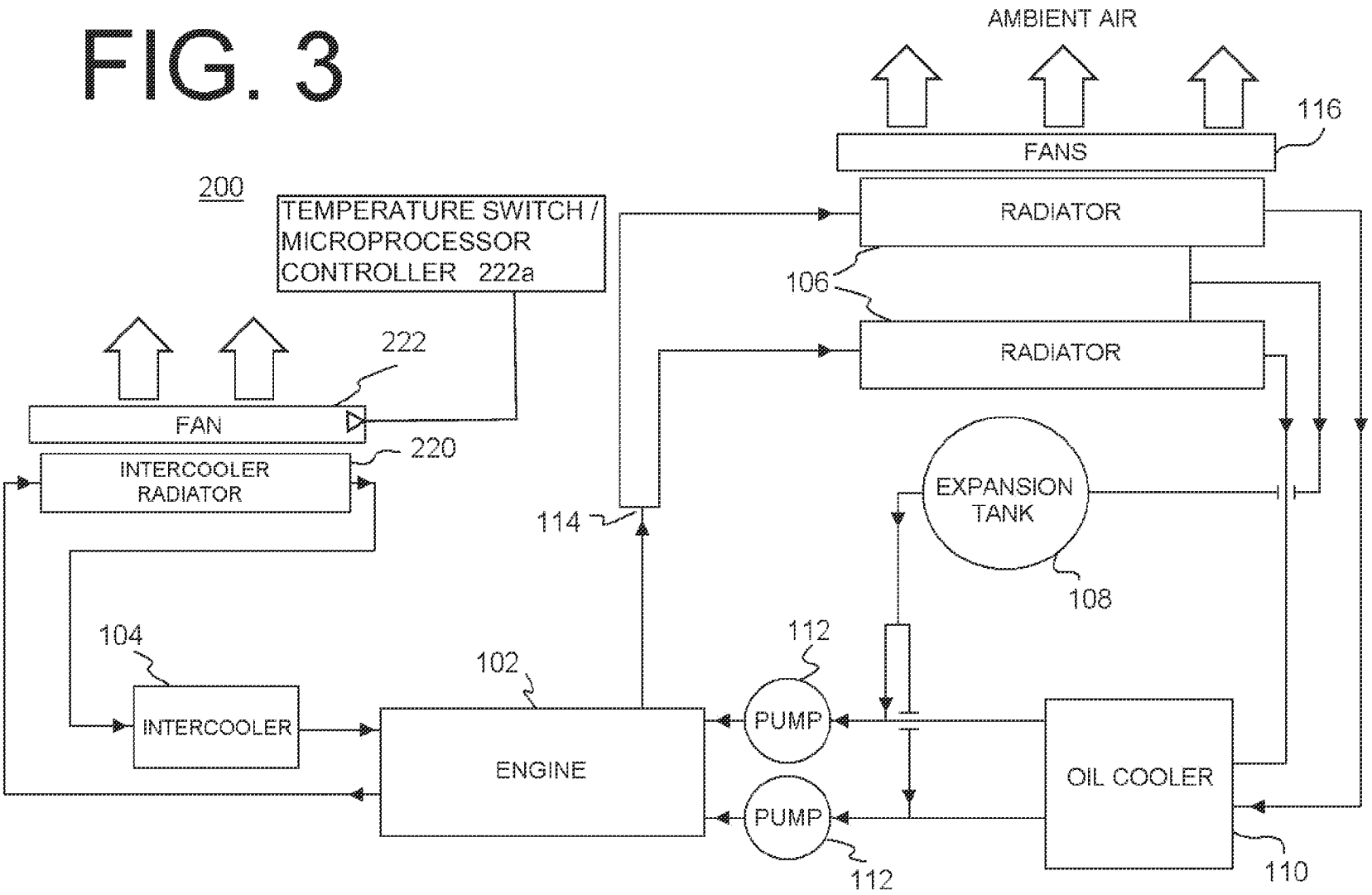
FIG. 3 is a diagram of a cooling system for a diesel locomotive engine according to one embodiment the present invention.

Referring now to FIG. 3, one embodiment of a system of the present invention is depicted. As shown in FIG. 3, one aspect of the present invention is an extension of the intercooler loop of the prior art. Cooling system 200 includes an intercooler radiator 220 on the opposite end of engine 102 from at least one radiator 106. Upon exiting the engine 102 liquid coolant passes through the intercooler radiator 220 before entering at least one intercooler 104. The intercooler radiator 220 may be cooled by ambient air provided by a dedicated fan 222. Dedicated fan 222 provides an ambient air path for intercooler radiator 220 that is independent of the ambient air path provided by the at least one fan 116 of the at least one radiator 106. The liquid coolant would then be returned to engine 102 from intercooler 104 and continue the cooling system process as described above in reference to FIG. 1. The dedicated fan 222 for intercooler radiator 220 may be controlled by a temperature switch or microprocessor controller 222*a*. For example, in one embodiment of the present invention, the temperature switch 222*a* may energize dedicated fan 222 when the liquid coolant temperature is above 150 degree Fahrenheit and may de-energize dedicated fan 222 when the liquid coolant temperature is below 140 degrees F. The temperature switch 222*a* may receive the temperature input from a temperature sensor located within cooling system 200. In one embodiment, the temperature sensor is located between engine 102 and intercooler radiator 220.

One feature of the present invention is that the additional split cooling loop provided by intercooler radiator 220 provides a lower temperature liquid coolant to the at least one intercooler 104. As explained above in reference to FIG. 1, at least one intercooler 104 cools the charge air to increase the charge density. This higher air density increases combustion efficiency. In the prior art cooling system 100 shown in FIG. 1, the amount of cooling by the at least one intercooler 104 is limited by the temperature of the liquid coolant as dictated by the optimum cylinder liner and cylinder head temperatures. This is because the liquid coolant flows directly from engine 102 to at least one intercooler 104. In the present invention, however, the liquid coolant is cooled by the intercooler radiator 220 after it leaves engine 102 but before it enters at least one intercooler 104. It is advantageous to provide this cooler liquid coolant to the at least one intercooler 104 to reduce the charge air temperature which will reduce the emissions from engine 102. Another feature of the present invention is that the cooler charge air results in lower fuel consumption.

Figure 4:
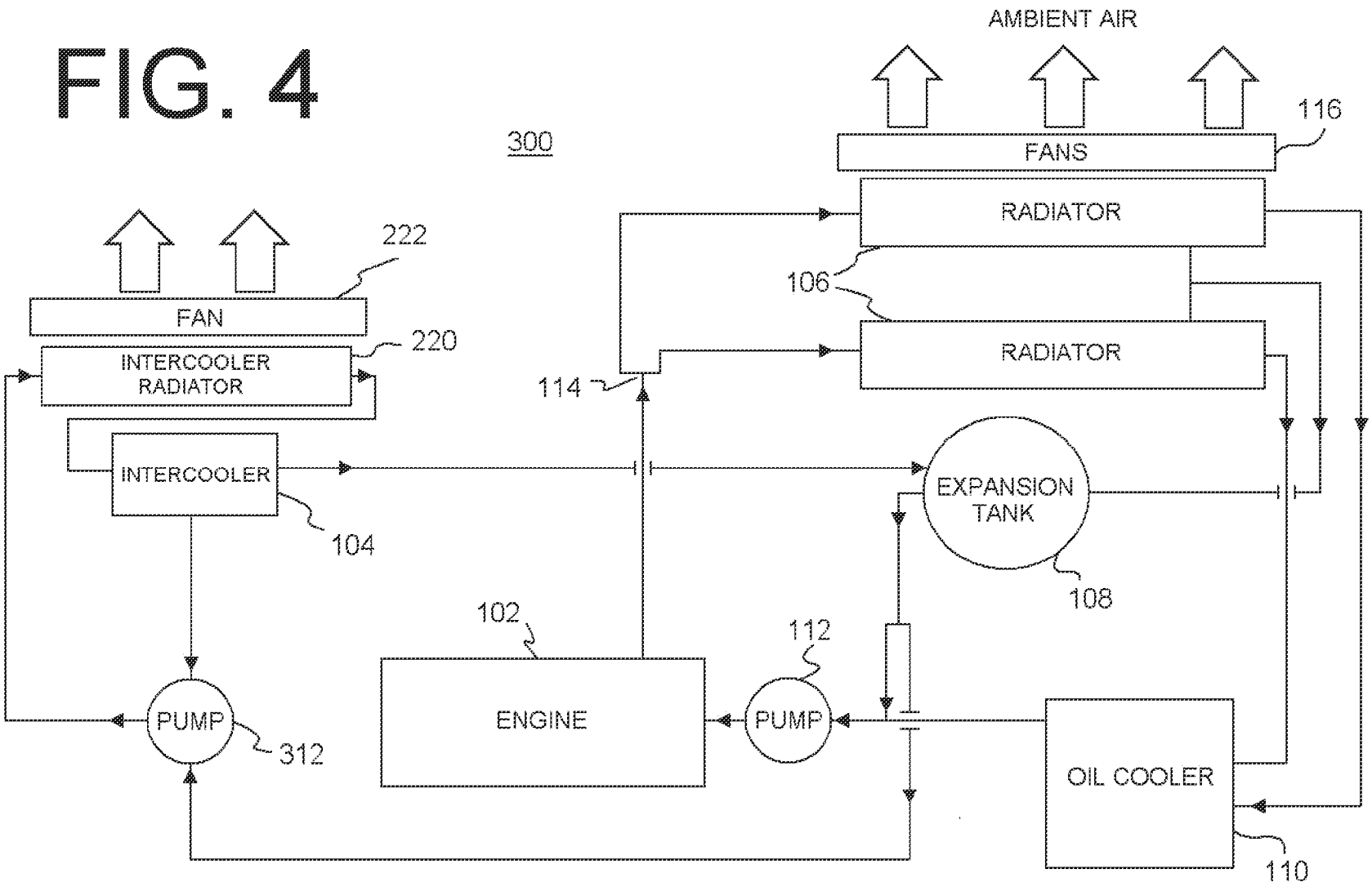
FIG. 4 is a diagram of a cooling system for a diesel locomotive engine according to another embodiment of the present invention.

Referring now to FIG. 4, another embodiment of the system of the present invention is depicted. As shown in FIG. 4, another aspect of the present invention may include an intercooler pump 312, either engine driven or motor driven, which pumps the liquid coolant through intercooler radiator 220 and intercooler 104, bypassing engine 102. There may also be a connection from intercooler 104 to expansion tank 108, bypassing radiator 106. There may also be a connection from expansion tank 108 to the intercooler pump 312. The embodiment shown in FIG. 3 may help ensure that intercooler radiator 220 and intercooler radiator fan 222 are on the opposite side of engine 102 from the at least one radiator 106.

Figure 5:
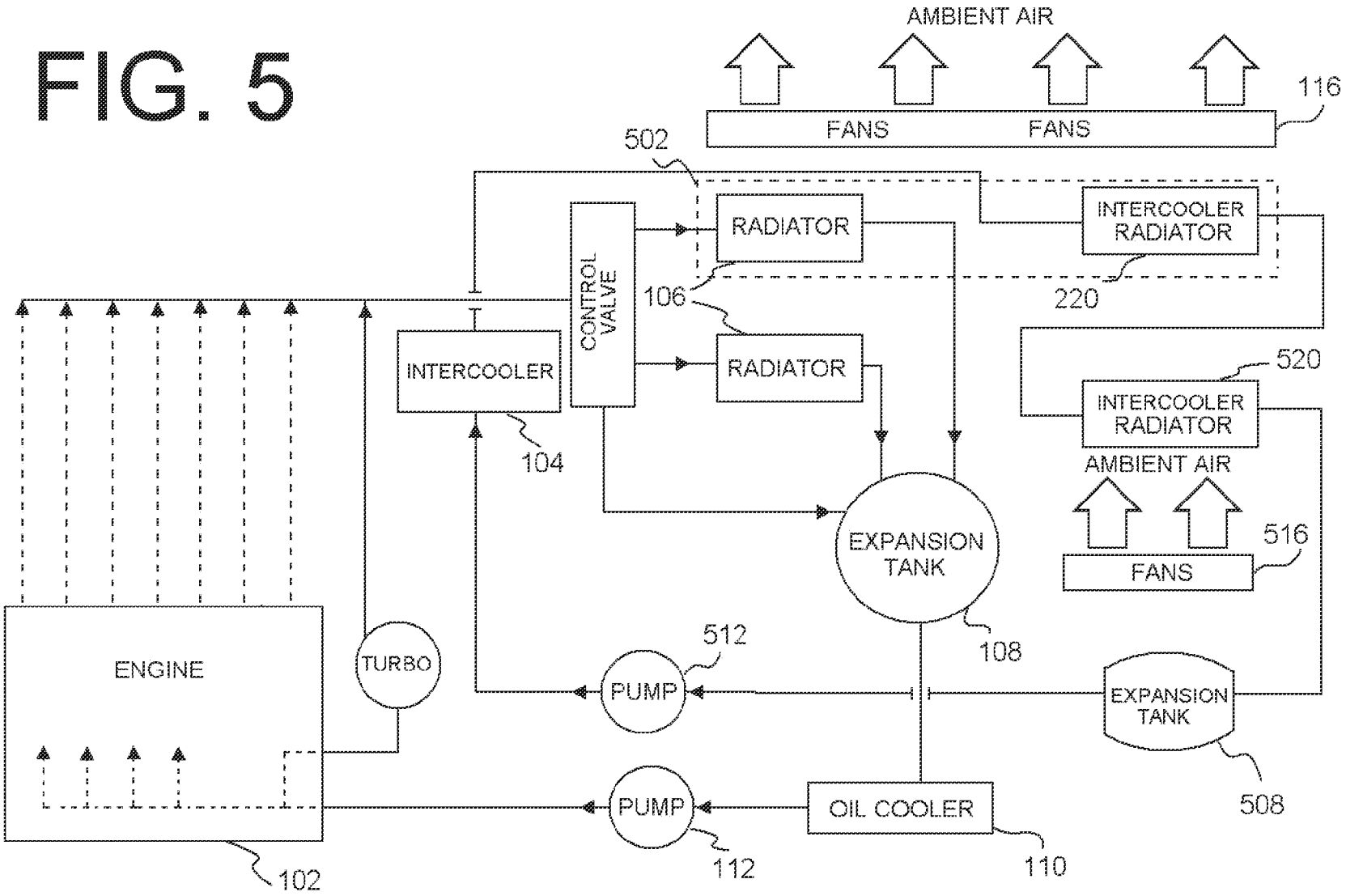
FIG. 5 is a diagram of a cooling system for a diesel locomotive engine according to an alternative embodiment of the present invention.

Referring now to FIG. 5 an alternative embodiment of the system of the present invention is depicted. As shown in FIG. 5, another aspect of the present invention may include the alteration of the at least one radiator 106 such that a radiator bank 502 is split to allow for the cooling of both the engine coolant and intercooler coolant. The existing shared fan 116 would provide ambient cooling air for both at least one radiator 106 and the intercooler radiator 220. The intercooler coolant would then proceed to another dedicated intercooler radiator 520 that is cooled with ambient air supplied by a dedicated fan 516. Upon exiting the intercooler radiator 520, the coolant would then proceed to another expansion tank 508. It would then be pumped via a dedicated pump 512 and on to the intercooler 104 to repeat the process.

Figure 6:
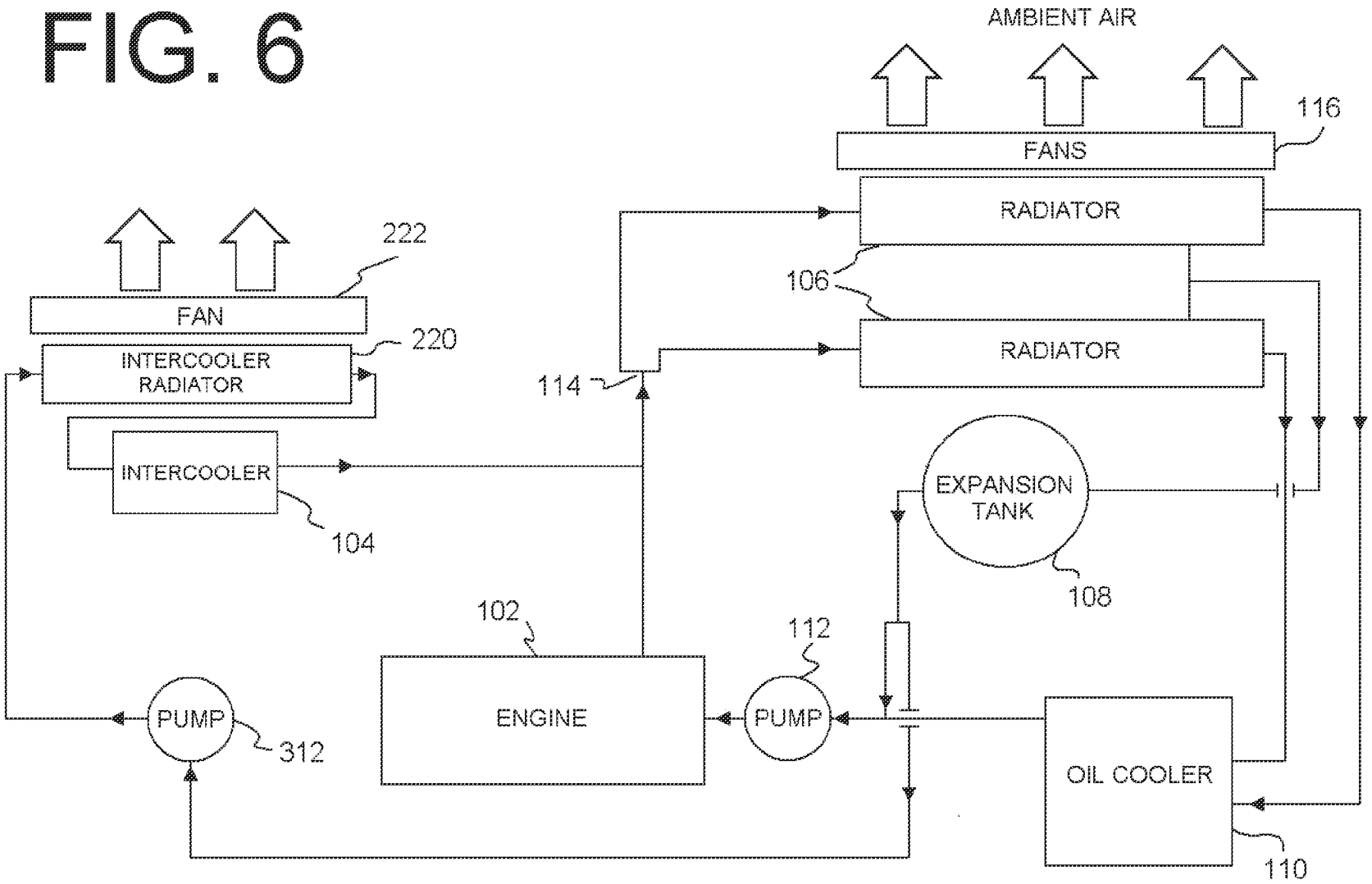
FIG. 6 is a diagram of a cooling system for a diesel locomotive engine according to another embodiment of the present invention.

Referring now to FIG. 6, an alternative embodiment of the present invention is depicted. As shown in FIG. 6, this embodiment is a variation of invention as depicted in FIG. 4. After exiting the intercooler 104, the coolant is directed to the at least one radiator 106, bypassing the engine 102, expansion tank 108 and separate intercooler pump 312. The coolant that enters the expansion tank 108 is split upon exiting the expansion tank 108 where some of the coolant is directed to the engine 102 and the remainder is directed to the intercooler pump 312, where it re-starts the intercooler cooling process.

Figure 7:
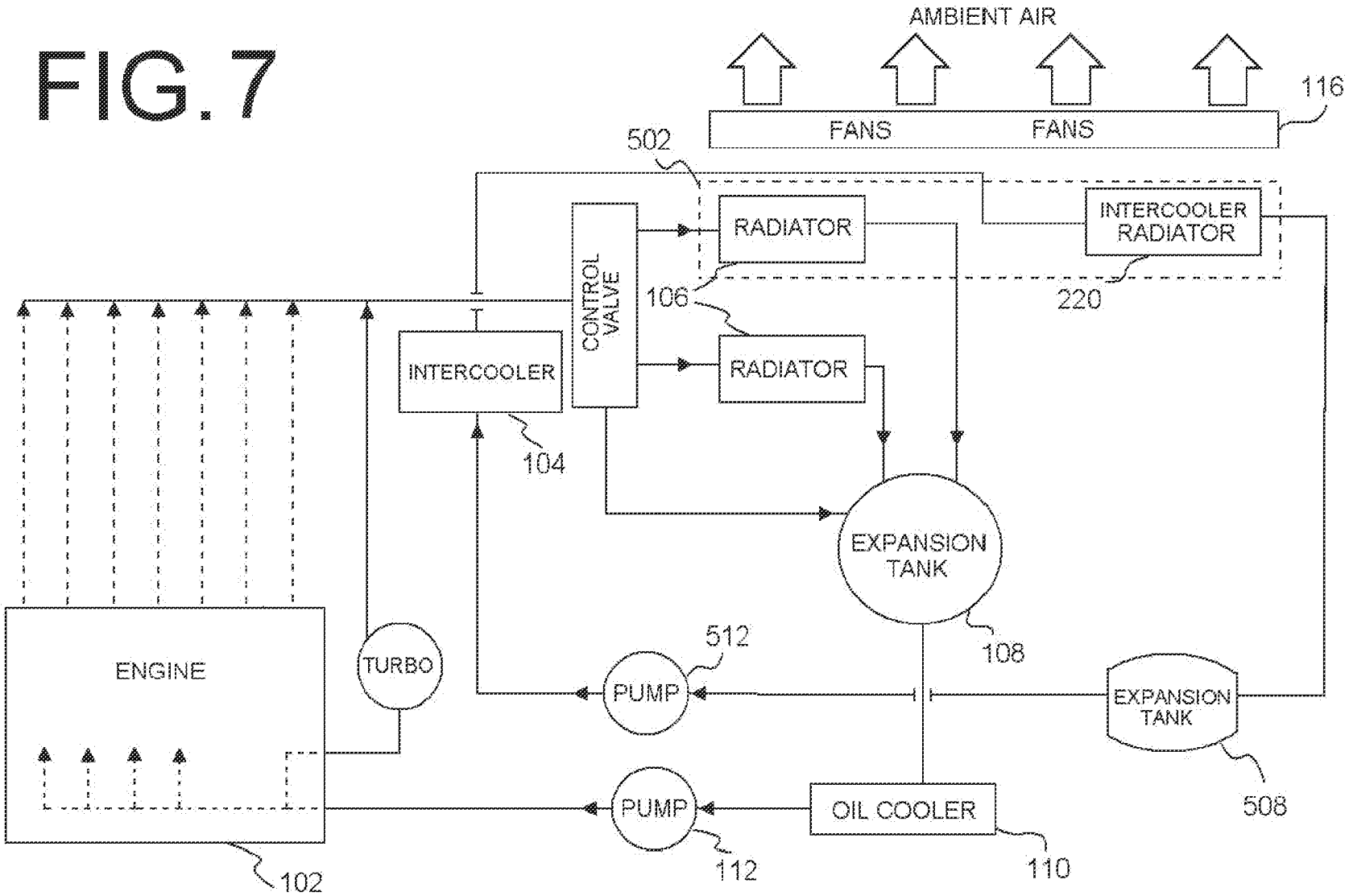
FIG. 7. is a diagram of a cooling system for a diesel locomotive engine according to another embodiment of the present invention.

Referring now to FIG. 7, an alternative embodiment of the present invention is depicted. As shown in FIG. 7. this embodiment is a variation of invention as depicted in FIG. 5. This variation does not include a separate fan for the intercooler radiator 220, but utilizes the distinctly separate coolant loop with at least one intercooler radiator 220 for the intercooler loop and uses at least one fan 116 that provides ambient cooling air for both the intercooler radiator 220 and the radiator 106. As in FIG. 5, this embodiment also contains a separate expansion tank 508 and pump 512 for the intercooler coolant loop.

The embodiments described above are given as illustrative examples only. It will be readily appreciated by those skilled in the art that many deviations may be made from the specific embodiments disclosed in this specification without departing from the invention. Accordingly, the scope of the invention is to be determined by the claims below rather than being limited to the specifically described embodiments above.

What is claimed is:

1. A cooling system for an internal combustion engine comprising:

a first cooling loop for an engine, said first cooling loop cooling a first liquid coolant from said engine and directing said first liquid coolant back to said engine; and a second cooling loop for said engine, said second cooling loop cooling a second liquid coolant from said engine and directing said second liquid coolant back to said engine without passing said second coolant through said first cooling loop, said second cooling loop comprising:

an intercooler for receiving combustion air from a turbocharger, the intercooler comprising an air-to-liquid heat exchanger for exchanging heat between the combustion air and the second liquid coolant;

an intercooler radiator comprising:

a heat exchanger for exchanging heat between the second liquid coolant and ambient air; and a fan.

2. The cooling system of claim 1, wherein the fan is controlled by a temperature switch or a microprocessor controller.

3. The cooling system of claim 2, wherein the temperature switch comprises a temperature sensor which detects a temperature of the second liquid coolant.

4. The cooling system of claim 3, wherein the temperature switch or controller energizes the fan when the temperature of the second liquid coolant is within a specified range of temperatures.

5. The cooling system of claim 3, wherein the temperature switch or controller de-energizes the fan when the temperature of the second liquid coolant is within a specified range of temperatures.

6. The cooling system of claim 1, said first cooling loop further comprising:

at least one engine coolant radiator;

an expansion tank;

an oil cooler; and at least one pump.

7. The cooling system of claim 6, wherein the at least one engine coolant radiator and the intercooler radiator are located on opposite sides of the engine.

8. A cooling system for an internal combustion engine comprising:

a first cooling loop for an engine, said first cooling loop, for cooling a first liquid coolant from said engine and directing said first liquid coolant back to said engine, comprising:

at least one engine coolant radiator;

an expansion tank;

an oil cooler; and at least one pump; and a second cooling loop for said engine, said second cooling loop cooling a second liquid coolant from said engine and directing said second liquid coolant back to said engine without passing said second coolant through said first cooling loop, said second cooling loop comprising:

an intercooler for receiving combustion air from a turbocharger, the intercooler comprising an air-to-liquid heat exchanger for exchanging heat between the combustion air and the second liquid coolant;

an intercooler radiator comprising:

a heat exchanger for exchanging heat between the second liquid coolant and ambient air and a fan;

wherein the fan is controlled by a temperature switch or a microprocessor controller, wherein the temperature switch comprises a temperature sensor which detects a temperature of the second liquid coolant, wherein the temperature switch or controller energizes the fan when the temperature of the second liquid coolant is within a specified range of temperatures, wherein the temperature switch or controller de-energizes the fan when the temperature of the second liquid coolant is within a specified range of temperatures.

9. The cooling system of claim 8, wherein the at least one engine coolant radiator and the intercooler radiator are located on opposite sides of the engine.

* * * * *